US011408133B2

(12) United States Patent
Xiao et al.

(10) Patent No.: US 11,408,133 B2
(45) Date of Patent: Aug. 9, 2022

(54) PAVEMENT DEICING OR SNOW-MELTING SYSTEM AND CONSTRUCTION METHOD THEREOF

(71) Applicant: HUBEI UNIVERSITY OF TECHNOLOGY, Hubei (CN)

(72) Inventors: Henglin Xiao, Hubei (CN); Ming Han, Hubei (CN); Zhi Chen, Hubei (CN); Qiang Ma, Hubei (CN); Lihua Li, Hubei (CN); Zhiyong Yang, Hubei (CN); Mi Tian, Hubei (CN); Hefu Pu, Hubei (CN); Shilin Wan, Hubei (CN)

(73) Assignee: HUBEI UNIVERSITY OF TECHNOLOGY, Wuhan (CN)

( * ) Notice: Subject to any disclaimer, the term of this patent is extended or adjusted under 35 U.S.C. 154(b) by 348 days.

(21) Appl. No.: 16/675,292

(22) Filed: Nov. 6, 2019

(65) Prior Publication Data

US 2020/0141069 A1 May 7, 2020

(30) Foreign Application Priority Data

Nov. 7, 2018 (CN) ..... 201811320154.3

(51) Int. Cl.

| | |
|---|---|
| ***E01C 11/26*** | (2006.01) |
| ***E01C 11/22*** | (2006.01) |
| ***E01C 11/24*** | (2006.01) |

(52) U.S. Cl.

CPC ..... *E01C 11/265* (2013.01); *E01C 11/225* (2013.01); *E01C 11/228* (2013.01); *E01C 11/245* (2013.01); *E01C 2201/20* (2013.01)

(58) Field of Classification Search

CPC ..... E01C 11/228
USPC ..... 404/17, 31, 72–79, 95
See application file for complete search history.

(56) References Cited

U.S. PATENT DOCUMENTS

| | | | | |
|---|---|---|---|---|
| 4,011,022 A * | 3/1977 | Welty | E01C 5/22 | 404/40 |
| 6,206,607 B1 * | 3/2001 | Medico, Jr. | E01C 19/463 | 404/2 |
| 9,938,670 B2 * | 4/2018 | White | E01C 19/52 | |
| 10,918,212 B2 * | 2/2021 | Lim | H05B 3/145 | |

(Continued)

FOREIGN PATENT DOCUMENTS

| | | |
|---|---|---|
| CN | 203668794 U | 6/2014 |
| CN | 204069393 U * | 12/2014 |

(Continued)

*Primary Examiner* — Raymond W Addie

(57) ABSTRACT

The present invention provides a pavement deicing or snow-melting system, comprising a water-permeable pavement, a drainage device and a heating device, wherein the water-permeable pavement comprises, successively from the top down, a water-permeable asphalt concrete coating, a porous cement stabilized macadam layer, a reflecting layer, a waterproof layer, a semi-rigid base and a semi-rigid cushion; the drainage device comprises a drainage ditch and a sheet cover; a water inlet is formed on the drainage ditch; a lower edge of the drainage ditch is not lower than the waterproof layer; curbs are arranged on edges of the water-permeable asphalt concrete coating and the porous cement stabilized macadam layer; and, the heating device is arranged between the water-permeable asphalt concrete coating and the porous cement stabilized macadam layer.

11 Claims, 2 Drawing Sheets

(56) References Cited

U.S. PATENT DOCUMENTS

| | | | | |
|---|---|---|---|---|
| 2005/0047866 | A1* | 3/2005 | Chen | E01C 11/225<br>404/75 |
| 2012/0171326 | A1* | 7/2012 | Harris | A23G 4/06<br>426/6 |
| 2019/0078269 | A1* | 3/2019 | von Langsdorff | E01C 11/24 |

FOREIGN PATENT DOCUMENTS

| | | | | |
|---|---|---|---|---|
| CN | 205223790 | U | * | 5/2016 |
| CN | 106835896 | A | | 6/2017 |
| CN | 108755340 | A | | 11/2018 |
| JP | H07119111 | A | * | 5/1995 |
| JP | 2000096509 | A | * | 4/2000 |
| JP | 2001248108 | A | * | 9/2001 |
| JP | 2005048403 | A | * | 2/2005 |
| JP | 2008248656 | A | * | 10/2008 |
| KR | 101193385 | B1 | * | 10/2012 |

* cited by examiner

PAVEMENT DEICING OR SNOW-MELTING SYSTEM AND CONSTRUCTION METHOD THEREOF

CROSS-REFERENCE TO RELATED APPLICATIONS

This application claims the benefit of priority from Chinese Patent Application No. CN201811320154.3, filed on Nov. 7, 2018. The content of the aforementioned application, including any intervening amendments thereto, is incorporated herein by reference in its entirety.

TECHNICAL FIELD

The present invention belongs to the technical field of the construction of roads and bridges, and particularly relates to a pavement deicing or snow-melting system and a construction method thereof.

BACKGROUND OF THE PRESENT INVENTION

At present, in China, manual deicing, mechanical cleaning and chemical deicing methods are generally used to keep the road free of snow and ice. The first two methods have disadvantages of high consumption of manpower and material resources, low response speed and low efficiency, and may interfere with the normal passage of pedestrians. For the third method, with the use of the deicing salt, the molten ice and snow will penetrate the land surface, resulting in environment pollution and soil salinization, and also the corrosion of the bridge deck and the steel bar environment. By solely paving water-permeable concrete or asphalt, only water accumulation on the pavement can be overcome. This can realize the purpose of skid resistance. However, snow accumulation in the cold and snowy weather may also lead to accidents because of slipping of pedestrians and vehicles.

The existing pavement deicing or snow-melting methods are low in energy utilization and high in energy consumption. It is necessary to design a pavement deicing or snow-melting system which can realize pavement deicing or snow-melting while being energy saving and environment friendly.

SUMMARY OF THE PRESENT INVENTION

The purpose of the present invention is to provide a pavement deicing or snow-melting system, which solves the technical problems of high energy consumption and low energy utilization during the process of pavement deicing or snow-melting in the prior art.

For this purpose, the present invention provides a pavement deicing or snow-melting system, including a water-permeable pavement, a drainage device and a heating device, wherein the water-permeable pavement includes, successively from the top down, a water-permeable asphalt concrete coating, a porous cement stabilized macadam layer, a reflecting layer, a waterproof layer, a semi-rigid lower foundation layer and a semi-rigid cushion; the drainage device includes a drainage ditch and a sheet cover; a water inlet is formed on the drainage ditch; a lower edge of the drainage ditch is not lower than the waterproof layer; curbs are arranged on edges of the water-permeable asphalt concrete coating and the porous cement stabilized macadam layer; and, the heating device is arranged between the water-permeable asphalt concrete coating and the porous cement stabilized macadam layer.

Compared with the prior art, the present invention has the following beneficial effects. The pavement deicing or snow-melting system in the present invention includes a water-permeable pavement, a drainage device and a heating device, and the water-permeable pavement includes, successively from the top down, a water-permeable asphalt concrete coating, a porous cement stabilized macadam layer, a reflecting layer, a waterproof layer, a semi-rigid base and a semi-rigid cushion from the pavement down. The reflecting layer can reflect upward the heat generated by the heating device, so that most of the heat is reflected and conducted upward, and the energy utilization during the deicing or snow-melting process is improved.

Preferably, the drainage device further includes an ultrasonic drainage promotion device which is arranged on the bottom of the porous cement stabilized macadam layer.

Preferably, the heating device includes a carbon fiber heating cable on which an iron wire is spirally wound, and the carbon fiber heating cable is arranged in a continuous U-shape.

Preferably, the reflecting layer is made of a composite aluminum film.

Preferably, both the water-permeable asphalt concrete coating and the porous cement stabilized macadam layer contain gypsum power, with the content of the gypsum power in the water-permeable asphalt concrete coating being 625 g/m$^3$ and the content of the gypsum power in the porous cement stabilized macadam layer being 250 g/m$^3$.

The present invention further provides a construction method of the pavement deicing or snow-melting system, including following steps:

step 1: successively paving the semi-rigid cushion and the semi-rigid base from the bottom up, reserving a construction position on the semi-rigid base, and paving the waterproof layer in a region other than the construction position on the semi-rigid base;

step 2: paving the porous cement stabilized macadam layer on the waterproof layer, placing the curbs after reaching a proper elevation, continuously pouring to complete the pavement of the porous cement stabilized macadam layer, and waiting for the final setting of the porous cement stabilized macadam layer;

step 3: erecting the heating device on the porous cement stabilized macadam layer;

step 4: paving the water-permeable asphalt concrete coating on the heating device and the porous cement stabilized macadam layer; and step 5: forming the drainage ditch at the construction position, with the lower edge of the water inlet being not lower than the waterproof layer.

Preferably, the heating device includes a carbon fiber heating cable.

Preferably, the heating device includes a carbon fiber heating cable; and, in the step 3, an iron wire is spirally wound on the carbon fiber heating cable so that the carbon fiber heating cable is fixed in a continuous U-shape, and the carbon fiber heating cable is erected on the porous cement stabilized macadam layer by cushion stones.

Preferably, before the pavement of the porous cement stabilized macadam layer, gypsum powder is mixed in slurry of the porous cement stabilized macadam layer, 625 g per cubic meter; and, before the pavement of the water-permeable asphalt concrete coating, gypsum powder is mixed in slurry of the water-permeable asphalt concrete coating, 250 g per cubic meter.

BRIEF DESCRIPTION OF THE DRAWINGS

In order to explain the embodiments of the present invention more clearly, the accompanying drawings to be used in the embodiments will be described briefly. Apparently, the accompanying drawings to be described hereinafter are merely some embodiments of the present invention, and those skilled in the art can obtain other drawings according to these drawings without paying any creative effort.

DETAILED DESCRIPTION OF THE PRESENT INVENTION

To make the purposes, technical solutions and advantages of the present invention clearer, the technical solutions in the embodiments of the present invention will be described clearly and completely below with reference to the accompanying drawings in the embodiments of the present invention. Apparently, the embodiments to be described herein are merely some but not all of the embodiments of the present invention. All other embodiments obtained based on the embodiments of the present invention by those skilled in the art without paying any creative effort shall fall into the protection scope of the present invention.

Figure 1:
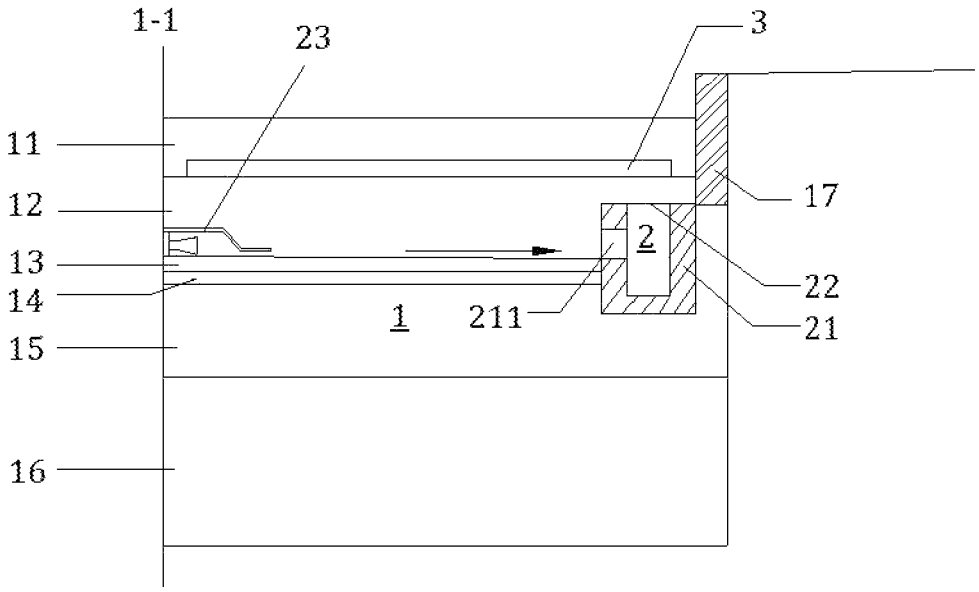
FIG. 1 is a schematic structure diagram of a pavement deicing or snow-melting system according to an embodiment of the present invention.

The present invention provides a pavement deicing or snow-melting system. As shown in FIG. 1, the pavement deicing or snow-melting system in FIG. 1 is bilaterally symmetrical about a line 1-1. The pavement deicing or snow-melting system includes a water-permeable pavement 1, a drainage device 2 and a heating device 3. The water-permeable pavement 1 includes, successively from the top down, a water-permeable asphalt concrete coating 11, a porous cement stabilized macadam layer 12, a reflecting layer 13, a waterproof layer 14, a semi-rigid base 15, a semi-rigid cushion 16 and curbs 17. The curbs 17 are arranged on edges of the water-permeable asphalt concrete coating 11 and the porous cement stabilized macadam layer 12. The heating device 3 is arranged between the water-permeable asphalt concrete coating 11 and the porous cement stabilized macadam layer 12.

Both the water-permeable asphalt concrete coating 11 and the porous cement stabilized macadam layer 12 are highly water-permeable, so that the heat generated by the heating device 3 can be quickly released through gaps therein and the molten snow water can quickly penetrate the bottom of the porous cement stabilized macadam layer 12. In some embodiments of the present invention, the water-permeable asphalt concrete coating 11 has a thickness of 8 cm, the porous cement stabilized macadam layer 12 has a thickness of 20 cm, the semi-rigid base 15 has a thickness of 10 cm, the semi-rigid cushion 16 has a thickness of 20 cm and the curbs 17 have a height of 20 cm.

Specifically, both the water-permeable asphalt concrete coating 11 and the porous cement stabilized macadam layer 12 contain gypsum power, where the content of the gypsum power in the water-permeable asphalt concrete coating 11 is 625 g/m$^3$ and the content of the gypsum power in the porous cement stabilized macadam layer 12 is 250 g/m$^3$. The temperature seams in the water-permeable asphalt concrete coating 11 and the porous cement stabilized macadam layer 12 caused by heating or cement dehydration can be effectively reduced.

Specifically, the reflecting layer 13 is made of a composite aluminum film. The reflecting layer 13 can reflect upward the heat generated by the heating device 3, so that most of the heat is reflected and conducted upward, and the energy utilization during the deicing or snow-melting process is improved.

The waterproof layer 14 may be made of polyethylene waterproof film material.

The drainage device 2 includes a drainage ditch 21 and a sheet cover 22 covered at the upper end of the drainage ditch 21. The drainage ditch 21 extents in a lengthwise direction of the pavement. In some embodiments, the drainage ditch 21 has a depth of 30 cm and a width of 20 cm, and the slope of the drainage ditch 21 relative to the pavement in its extension direction is 5%. A water inlet 211 is further formed on the drainage pitch 21. The water inlet 211 is preferably a grating-type hole, and the lower edge of the water inlet 211 is not lower than the waterproof layer 14.

Specifically, the drainage device 2 further includes an ultrasonic drainage promotion device 23 which is arranged on the bottom of the porous cement stabilized macadam layer 12.

Figure 2:
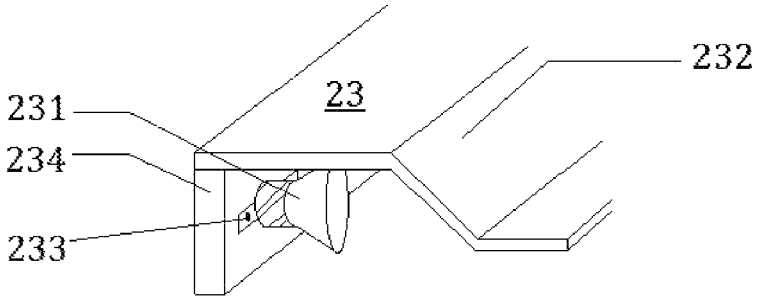
FIG. 2 is a schematic structure diagram of an ultrasonic drainage promotion device according to an embodiment of the present invention.

In some embodiments, as shown in FIG. 2, the ultrasonic drainage promotion device 23 includes ultrasonic transducers 231, an ultrasonic wave centralization, orientation and amplification component 232, fixation bolts 233 and a solid wood fixation board 234. The solid wood fixation board 234 is elongated, extends in the lengthwise direction of the pavement, and has a width of 10 cm. The solid wood fixation board 234 is arranged on the bottom of the porous cement stabilized macadam layer 12. The ultrasonic transducers 231 are arranged at an interval of 20 cm in the lengthwise direction of the solid wood fixation board 234, and the ultrasonic transducers 231 are fixed on the solid wood fixation board 234 by the fixation bolts 233. The ultrasonic transducers 231 convert the electric energy into ultrasonic wave. The frequency of the ultrasonic wave is preferably not lower than 24 KHz. In this way, water on the waterproof layer 14 is accelerated to quickly flow into the drainage device 2, and a large amount of water adhered to the reflecting layer 13 may also be allowed to quickly low into the drainage device 2. Accordingly, the possibility of the galvanic cell oxidation reaction among water, air and the reflecting layer 13 is reduced, and the service life of the reflecting layer 13 is thus prolonged.

In some embodiments, the ultrasonic wave centralization, orientation and amplification component 232 is elongated, and is arranged in the lengthwise direction of the solid wood fixation board 234 and fixed on the solid wood fixation board 234. A fixed end of the ultrasonic wave centralization, orientation and amplification component 232 is arranged above the ultrasonic transducers 231, the ultrasonic wave centralization, orientation and amplification component 232 extends outward from the fixed end in a propagation direction of ultrasonic wave, and a free end of the ultrasonic wave centralization, orientation and amplification component 232 is bent downward, so that the ultrasonic transducers 231 are located in a space enclosed by the solid wood fixation board 234, the waterproof layer 14 and the ultrasonic wave centralization, orientation and amplification component 232. An opening is formed between a downward-bent portion of the ultrasonic wave centralization, orientation and amplification component 232 and the waterproof layer 14. The opening is preferably a grating-type hole. The ultrasonic wave is orientated, centralized and amplified after passing through the opening from the enclosed space. The ultrasonic wave centralization, orientation and amplification component 232 is preferably made of a glued solid wood fixation board to reduce the ineffective propagation of ultrasonic wave.

Figure 3:
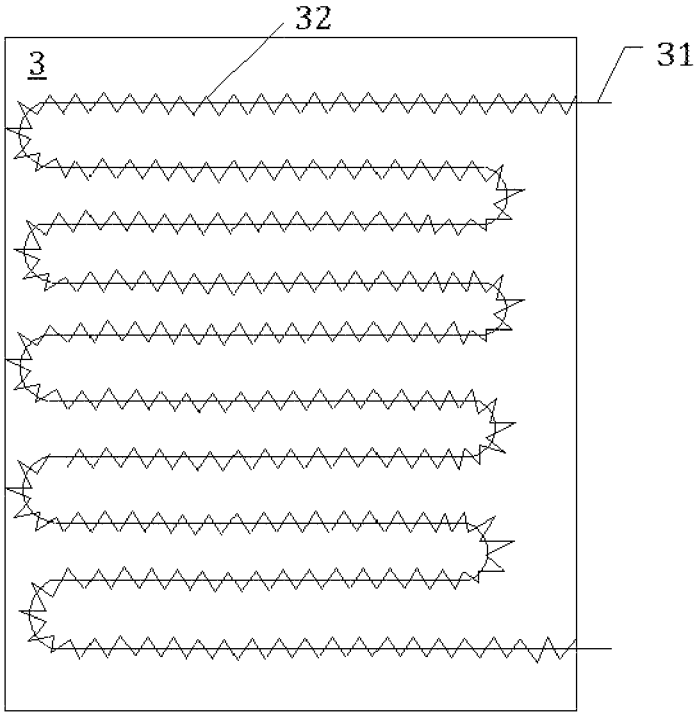
FIG. 3 is a schematic view of the structure and arrangement of a heating device according to an embodiment of the present invention.

Specifically, as shown in FIG. 3, the heating device 3 includes a carbon fiber heating cable 31 on which an iron wire 32 is spirally wound, and the carbon fiber heating cable 31 is arranged in a continuous U-shape.

The present invention further provides a construction method of the pavement deicing or snow-melting system, including the following steps.

Step 1: The semi-rigid cushion and the semi-rigid base are successively paved from the bottom up, a construction position is reserved on the semi-rigid base, and the waterproof layer is paved in a region other than the construction position on the semi-rigid base.

Step 2: The porous cement stabilized macadam layer is poured on the waterproof layer, the curbs are placed after reaching a proper elevation, continuously pouring is performed to complete the pavement of the porous cement stabilized macadam layer, and no operation is done till the final setting of the porous cement stabilized macadam layer.

Step 3: The heating device is erected on the porous cement stabilized macadam layer.

Step 4: The water-permeable asphalt concrete coating is paved on the heating device and the porous cement stabilized macadam layer.

Step 5: The drainage ditch is formed at the construction position, with the lower edge of the water inlet being not lower than the waterproof layer.

In the step 2, the proper elevation is a height at which the upper edges of the curbs completely placed in the porous cement stabilized macadam layer are leveled with the pavement.

Specifically, the heating device includes a carbon fiber heating cable.

Figure 4:
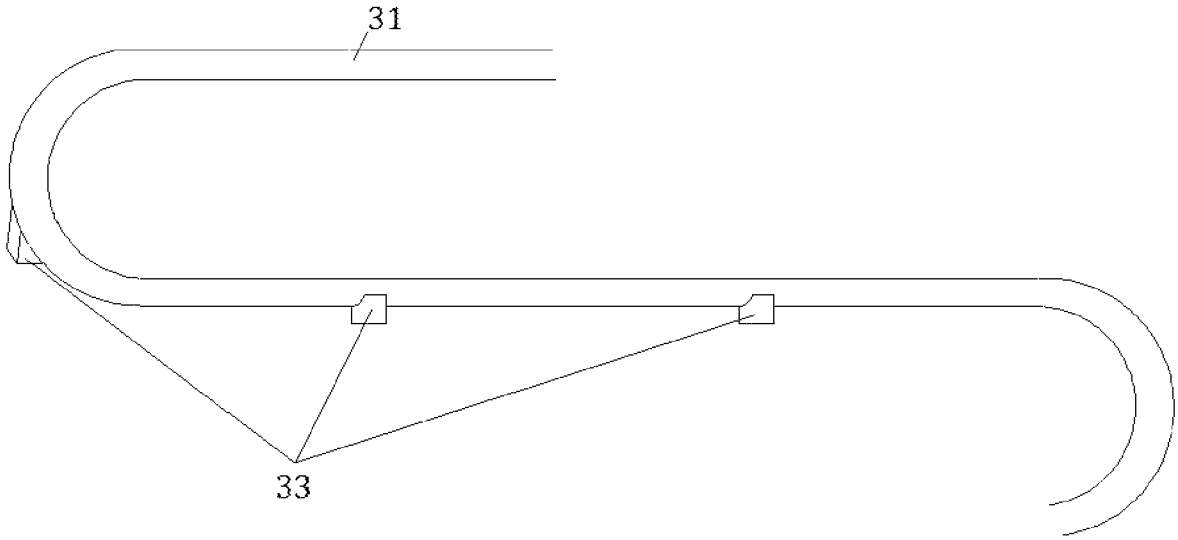
FIG. 4 is a schematic view of erecting a carbon fiber heating cable by cushion stones according to an embodiment of the present invention.

Specifically, the heating device includes a carbon fiber heating cable; and, in the step 3, an iron wire is spirally wound on the carbon fiber heating cable so that the carbon fiber heating cable is fixed in a continuous U-shape, and the carbon fiber heating cable is erected on the porous cement stabilized macadam layer by cushion stones. At least two cushion stones are used for each straight section. As shown in FIG. 4, at least one cushion stone 33 is used between corners of the carbon fiber heating cable 31. The cushion stones 33 are preferably concrete cushion stones made of concrete.

Specifically, before the pavement of the porous cement stabilized macadam layer, gypsum powder is mixed in slurry of the porous cement stabilized macadam layer, 625 g per cubic meter; and, before the pavement of the water-permeable asphalt concrete coating, gypsum powder is mixed in slurry of the water-permeable asphalt concrete coating, 250 g per cubic meter.

The above description of various embodiments of the present invention is provided to those skilled in the art only for illustrative purpose. It is not intended to be exhaustive or to limit the present invention to the disclosed single implementation. As described above, various replacements and variations of the present invention will be apparent for those skilled in the art to which the above technology belongs. Therefore, although some alternative implementations have been specifically discussed, other implementations will be apparent or readily available to those skilled in the art. The present invention is intended to include all replacements, modifications and variations that have been discussed herein, as well as other implementations that fall into the spirit and scope of the present application.

Although the present invention has been described by implementations, it will be appreciated by a person of ordinary skill in the art that many transformations and variations can be made to the present invention without departing from the spirit of the present invention, and these transformations and variations shall fall into the scope defined by the appended claims without departing from the spirit of the present invention.

What is claimed is:

1. A pavement deicing or snow-melting system, comprising:

a water-permeable pavement;

a drainage device;

a heating device; and an ultrasonic drainage promotion device comprising:

ultrasonic transducers configured to convert electric energy into ultrasonic wave;

a component for centralization, orientation and amplification of the ultrasonic wave;

fixation bolts; and a solid wood fixation board;

wherein the water-permeable pavement comprises, successively from the top down, a water-permeable asphalt concrete coating, a porous cement stabilized macadam layer, a reflecting layer, a waterproof layer, a semi-rigid base and a semi-rigid cushion;

the ultrasonic drainage promotion device is arranged on a bottom of the porous cement stabilized macadam layer;

the drainage device comprises a drainage ditch and a sheet cover;

a water inlet is formed on the drainage ditch;

a lower edge of the drainage ditch is not lower than the waterproof layer;

curbs are arranged on edges of the water-permeable asphalt concrete coating and the porous cement stabilized macadam layer; and the heating device is arranged between the water-permeable asphalt concrete coating and the porous cement stabilized macadam layer.

2. The pavement deicing or snow-melting system according to claim 1, wherein the solid wood fixation board is configured to extend in a lengthwise direction of the water-permeable pavement, and the ultrasonic transducers are fixed on the solid wood fixation board via the fixation bolts.

3. The pavement deicing or snow-melting system according to claim 1, wherein the heating device comprises a carbon fiber heating cable on which an iron wire is spirally wound, and the carbon fiber heating cable is arranged in a continuous U-shape.

4. The pavement deicing or snow-melting system according to claim 1, wherein a frequency of the ultrasonic wave is not lower than 24 KHz.

5. The pavement deicing or snow-melting system according to claim 1, wherein the reflecting layer is made of a composite aluminum film.

6. The pavement deicing or snow-melting system according to claim 1, wherein both the water-permeable asphalt concrete coating and the porous cement stabilized macadam layer contain gypsum powder, with the content of the gypsum powder in the water-permeable asphalt concrete coating being 625 g/m$^3$ and the content of the gypsum powder in the porous cement stabilized macadam layer being 250 g/m$^3$.

7. The pavement deicing or snow-melting system according to claim 1, wherein the component for the centralization, orientation and amplification of the ultrasonic wave is arranged in a lengthwise direction of the solid wood fixation board, and has a fixed end to the solid wood fixation board and a free end bent downward.

8. The pavement deicing or snow-melting system according to claim 7, wherein the component for the centralization, orientation and amplification of the ultrasonic wave is made of a glued solid wood fixation board.

9. A construction method of the pavement deicing or snow-melting system according to claim 1, comprising the following steps:

step 1: successively paving the semi-rigid cushion and the semi-rigid base from the bottom up, reserving a construction position on the semi-rigid base, and paving the waterproof layer in a region other than the construction position on the semi-rigid base;

step 2: forming the drainage ditch at the construction position, with the lower edge of the water inlet being not lower than the waterproof layer;

step 3: paving the porous cement stabilized macadam layer on the waterproof layer, placing the curbs after reaching a proper elevation, continuously pouring to complete the pavement of the porous cement stabilized macadam layer, and waiting for the final setting of the porous cement stabilized macadam layer;

step 4: erecting the heating device on the porous cement stabilized macadam layer; and step 5: paving the water-permeable asphalt concrete coating on the heating device and the porous cement stabilized macadam layer.

10. The construction method according to claim 9, wherein the heating device comprises a carbon fiber heating cable; and, in the step 4, an iron wire is spirally wound on the carbon fiber heating cable so that the carbon fiber heating cable is fixed in a continuous U-shape, and the carbon fiber heating cable is erected on the porous cement stabilized macadam layer by cushion stones.

11. The construction method according to claim 9, wherein, before the pavement of the porous cement stabilized macadam layer, gypsum powder is mixed in slurry of the porous cement stabilized macadam layer, 625 g per cubic meter; and, before the pavement of the water-permeable asphalt concrete coating, gypsum powder is mixed in slurry of the water-permeable asphalt concrete coating, 250 g per cubic meter.

* * * * *